US010233783B2

(12) United States Patent
Corbishley

(10) Patent No.: US 10,233,783 B2
(45) Date of Patent: Mar. 19, 2019

(54) APPARATUS AND METHOD OF ENERGY RECOVERY FOR USE IN A POWER GENERATING SYSTEM USING THE VENTURI EFFECT

(71) Applicant: James Corbishley, Fernhurst (GB)

(72) Inventor: James Corbishley, Fernhurst (GB)

(73) Assignee: James Corbishley, Fernhurst, West Sussex (GB)

( * ) Notice: Subject to any disclaimer, the term of this patent is extended or adjusted under 35 U.S.C. 154(b) by 116 days.

(21) Appl. No.: 15/116,416

(22) PCT Filed: Feb. 4, 2014

(86) PCT No.: PCT/GB2014/050299

§ 371 (c)(1),
(2) Date: Aug. 3, 2016

(87) PCT Pub. No.: WO2015/118282

PCT Pub. Date: Aug. 13, 2015

(65) Prior Publication Data

US 2017/0009605 A1 Jan. 12, 2017

(51) Int. Cl.

| | |
|---|---|
| ***F01K 3/00*** | (2006.01) |
| ***F01K 9/00*** | (2006.01) |
| ***F01K 11/02*** | (2006.01) |
| ***F01K 25/00*** | (2006.01) |

(52) U.S. Cl.

CPC ..... *F01K 3/008* (2013.01); *F01K 9/003* (2013.01); *F01K 11/02* (2013.01); *F01K 25/005* (2013.01)

(58) Field of Classification Search

CPC ... F24J 2/34; F24J 2/345; Y02E 60/14–60/17; F01K 23/02–23/108

See application file for complete search history.

(56) References Cited

U.S. PATENT DOCUMENTS

| | | | | |
|---|---|---|---|---|
| 2,325,036 | A * | 7/1943 | Case | F28F 1/006 138/44 |
| 2,441,279 | A | 5/1948 | McCollum | |
| 3,200,607 | A * | 8/1965 | Williams | F24F 3/147 62/274 |
| 3,459,953 | A | 8/1969 | Hughes et al. | |
| 3,557,554 | A * | 1/1971 | Martinek et al. | F01K 9/00 60/671 |
| 3,831,373 | A | 8/1974 | Flynt | |
| 7,908,872 | B2 * | 3/2011 | Williams | F25B 23/00 62/324.1 |
| 2009/0223650 | A1 | 9/2009 | Williams | |

FOREIGN PATENT DOCUMENTS

| | | |
|---|---|---|
| FR | 2286891 | 4/1976 |
| GB | 1419490 | 12/1975 |
| GB | 2504568 A | 2/2014 |
| WO | 9731184 A1 | 8/1997 |

* cited by examiner

*Primary Examiner* — Laert Dounis
(74) *Attorney, Agent, or Firm* — Gable Gotwals

(57) ABSTRACT

This invention relates to a method of condensing and energy recovery within a thermal power plant using the Venturi effect and gas stored under hydrostatic pressure and to an energy storage system using the method in a hydrogen and oxygen combusting turbine, where the hydrogen and oxygen gasses are produced by water electrolysis and hydrostatically pressurized and stored.

11 Claims, 5 Drawing Sheets

APPARATUS AND METHOD OF ENERGY RECOVERY FOR USE IN A POWER GENERATING SYSTEM USING THE VENTURI EFFECT

CROSS-REFERENCE TO RELATED APPLICATIONS

This United States application is the National Phase of PCT Application No. PCT/GB2014/050299 filed 4 Feb. 2014 which is incorporated herein by reference.

BACKGROUND OF THE INVENTION

Various methods of energy storage have been investigated in order to help integrate intermittent or invariant generating methods into electricity supply grids. Wind energy in particular, can require substantial backup and storage technologies to facilitate widespread use. Even with a relatively small proportion of wind energy, some capacity will be wasted when demand is low, and there are corresponding periods of higher demand but insufficient supply where backup generation must be used. The situation can be exacerbated as the proportion of wind energy increases. Supply and demand mismatch with wind can occur seasonally as well as in daily cycles, which creates a particular opportunity for storage systems with large generation duration times. Many large scale grid energy storage systems have found it difficult to compete with conventional gas turbines for load levelling variable energy sources, partly due to high capital costs, a shortage of potential sites, long build times, and energy losses due to various system inefficiencies.

Compressed air energy storage is well established in prior art. Such systems use air that has been compressed and stored during off peak periods to generate electricity on peak. The energy content of a quantity of compressed air is determined both by its pressure and its temperature, which temperature will increase with pressure. Adiabatic storage methods attempt to retain the heat of compression for recovery on expansion to increase efficiency levels, whereas simpler diabatic methods have no mechanism for retaining this heat. Storing compressed air in large underground formations, within pressure vessels, and under hydrostatic pressure is prior art. Methods of increasing power output by pre-heating the air with a waste heat source at a useable temperature, or by removing, storing, and then returning the heat of compression have also been investigated. The comparatively rapid response times possible with compressed air energy storage is particularly relevant to its ability to provide a backup generation source for wind.

The most common methods of electrical generation from a thermal energy source use turbo machinery to extract mechanical work, which mechanical work is used to drive a generator. The most common turbine cycles are the Brayton, Rankine, and combined cycles. The turbine's working fluid remains in gaseous form throughout in the Brayton cycle, where it is first compressed, then provided with a heat source (usually combustion), and then expanded through a turbine to recover energy. The working fluid is not usually recirculated within the Brayton cycle although such closed cycles would still fit within the definition. In contrast, the Rankine cycle continuously re-circulates its working fluid, which is present in both liquid and gaseous form at different stages in the cycle. The fluid in gaseous form, which has been expanded through the turbine to extract work, is condensed back to liquid to create a vacuum and flow in the turbine. That condensed liquid is then extracted from the condenser, re-pressurised, and introduced to a heat source where it is vaporised and supplied back to the turbine in gaseous form. The working fluid to be condensed is typically steam, and the fluid used to condense is typically air or water. Typical pressures within a steam condenser are sub-atmospheric at around 0.05 bar (5000 Pa). The significant amount of waste heat from condensing is dispersed as the temperatures involved are too low to be practicable for further energy recovery. The efficiency levels in terms of electrical recovery are up to 40% for both cycles. Combined cycle arrangements use both the Brayton and Rankine cycles, where the Rankine cycle extracts heat from the exhaust of the Brayton cycle to achieve an aggregate 60% electrical efficiency levels.

Hydrogen combusting gas turbines are also prior art. These turbines may be air breathing and produce the pollutant NOx, or combust hydrogen and oxygen gas in stoichiometric ratios, producing only steam. By way of example, a recuperating hydrogen oxygen combusting gas turbine has been disclosed in US Pat No WO97/31184 issued to Westinghouse Electric Corporation, where the waste heat from the steam is recuperated into the hydrogen fuel and oxygen. An energy storage method using a hydrogen oxygen combusting gas turbine with submerged water electrolysis and hydrostatically pressurised fuel and oxidiser storage is disclosed in French Pat No FR2286891 issued to Imberteche in 1976, which system does not specify a method of recovering the latent heat of vaporisation of the steam.

A peaking power system of an air breathing gas turbine using a compressed air storage system is disclosed by Flynt, in U.S. Pat. No. 3,831,373 published in 1974. The gas turbine disclosed can either operate conventionally, or the compressor of that turbine can be powered by off-peak electricity and used to compress air for storage, and on peak, the stored air can be released through the combustor and turbine in place of the compressor for increased generation output. Because the gas turbine is air breathing, its components can in effect be used simultaneously as part of the compressed air system. The air is stored under hydrostatic pressure in this system. In one embodiment, the system includes a method of using the heat of compression produced during storage by using a flow of water in a heat exchanger to produce steam, which steam is then expanded through the turbine and the rotational energy used to supplement the compressor.

The method of using the Venturi effect for both cooling and heating has been disclosed in U.S. Pat. No. 3,200,607 issued to Williams in 1965 whose space conditioning apparatus can be operated to provide either cooling or heating, and U.S. Pat. No. 2,441,279 issued to McCollum in 1942 whose Venturi system can simultaneously be used for cooling aircraft components and the heat extracted can be used for air conditioning. The method of using the Venturi effect within a heat exchanger to exchange heat between two mass flows is also disclosed in Patent Specification GB1,419,490 by Cowans in 1971. A further description of heat transfer using the Venturi effect is described in US Patent Application US2009/0223650 filed by Williams, which considers the possibility of using heat from a Venturi heat exchanger for power generation without elaborating as to any methodology. Although that document discusses exploiting the thermodynamic phase changes by the Bernoulli heat pump and notes the high energy content available due to such a phase change, that document does not disclose any mechanism or methodology for utilising that phase change.

According to the present invention there is provided a power generating system comprising a thermal power plant including:

(a) a vaporiser means for vaporising a first working fluid, a conduit means for conducting said (vaporised) first working fluid to a main power generating turbine for extracting energy from the first working fluid;

(b) conduit means for taking first working fluid exiting the main power turbine to a Venturi condenser, the first working fluid passing through heat exchanger means in the Venturi condenser to transfer heat to a second working fluid;

(c) the Venturi condenser, provided with an inlet for receiving a second working fluid at elevated pressure, an inlet portion leading to one or more Venturi tubes, the Venturi tubes having at least one converging inlet portion, at least one a straight constricted portion and at least one diverging outlet portion, and heat exchanger means surrounding the outlet portion;

(d) a second power turbine for extracting energy from the second working fluid exiting the one or more Venturi tubes;

(e) conduit means for returning said first working fluid to the vaporising means;

(f) pump means for pressurising said first working fluid and returning said first working fluid to the vaporising means;

(g) pump means for optionally pumping the second working fluid to a hydrostatically pressurised storage unit;

(h) storage means for storing said second working fluid in gaseous state under hydrostatic pressure;

(i) conduit means for conducting the second working fluid from said storage means to the inlet of the Venturi condenser;

(j) control means for controlling operation of the system.

Advantageously, the use of the Venturi condenser operating at an elevated pressure allows an increased efficiency of operation and allows the more effective cooling of a first working fluid exiting a main power generating turbine. The cooling effect on the fluid passing through the Venturi tube results in a greater temperature difference across the heat exchanger in the Venturi condenser than might otherwise be possible. This more effective cooling reduces the pressure of the fluid exiting the condenser and so more effectively draws the first working fluid through the main power generating turbine. Additionally, the energy transferred to the second working fluid in the condenser is sufficient to allow worthwhile and beneficial energy extraction by the secondary turbine, so increasing the overall system efficiency.

According to another aspect of the present invention there is provided a method of energy recovery for a thermal power plant which:

(a) a first working fluid delivering energy to a main power generating turbine then passes through a heat exchanger means in a Venturi condenser whereupon at least some of the remaining energy is extracted, and at least some of the first working fluid condenses to a liquid state (b) a second working fluid enters one or more Venturi tubes in a Venturi condenser at elevated pressure, the second working fluid cooling and decreasing in pressure as it passes through the Venturi tubes;

(c) the second working fluid absorbing thermal energy from the first working fluid in a heat exchanger means in the Venturi condenser;

(d) the reduced volume of the first working fluid causing a decreased pressure downstream of the main power generating turbine so increasing flow of the first working fluid through the main power generating turbine;

(e) the second working fluid after being heated in the heat exchanger means passing through a second power generating turbine where energy is extracted.

A particular embodiment of the system could be based around a 500 MW output hydrogen oxygen combusting gas turbine in a combined cycle arrangement, a water electrolysis system to supply the gasses for combustion, and a compressed air energy and Venturi condensing system which extracts the heat of vaporisation from the turbine cycle. The hydrogen oxygen turbine might be expected to achieve efficiency of around 62 percent, requiring around 804 MW combustion of hydrogen to produce that output. Around 10 percent of the combustion energy will be lost to component inefficiency, but around 266 MW will be lost due to the latent heat of vaporisation of the steam, which energy is not usually recoverable due to the low temperatures involved. The fuel and oxidiser requirement of such a turbine would be around 5.6 kg/sec of hydrogen and 45.4 kg/sec of oxygen to produce 51 kg/sec of superheated steam.

The conversion efficiency at producing hydrogen and oxygen gas for modern electrolysers is high, around 90-95% or more. Where the gasses need to be compressed or liquefied for storage, the chemical energy remaining will be around 65-70% percent of what. With a hydrostatically pressurised water feed and hydrostatic storage, the gasses do not need to be compressed, as the pressure head differential provides both compression and gas transmission forces. Such a system would be gravity fed and need no fuel and oxidiser pump. Additional thermal energy will be conserved by supplying the gasses at ambient temperatures rather than cryogenic temperatures, which is especially relevant given the very high specific heat capacity of hydrogen. Assuming an electrolyser efficiency level of 95%, the energy requirement for the electrolyser would be 845 MW. Proton exchange membrane electrolysers are capable of handling partial loads without compromising efficiency and can reach peak operating conditions rapidly, making them desirable for integrating intermittent energy sources and accommodating stochastic variations.

This electrolysis and hydrogen oxygen turbine based system would typically be combined with a compressed air system. Operating on its own, compressed air energy storage system might return round trip electrical efficiency levels of around 60 to 70 percent for isothermal systems where the heat of compression is reused, or 55 percent where the heat is dissipated. A Venturi condenser powered by hydrostatic pressure is used to remove and recover the heat of vaporisation energy most efficiently. It can be assumed that the air will be supplied to the Venturi at around between 4 and 25° Centigrade depending on the ambient conditions. The temperature in a deep coal mine will be significantly warmer than seabed temperatures. An air cooled condenser without the Venturi effect would only be able to condense due to the modest temperature difference between the steam entering the condenser and the temperature of the air used to extract heat. Using the Venturi effect to reduce temperature allows more intensive energy removal and recovery. For an observable temperature drop, it is necessary to increase the velocity to above Mach 0.3, otherwise the compression effects will be negligible. At high subsonic velocities of around Mach 0.8, the temperature is likely to drop to around −30 degrees Centigrade, and the air mass flow required to absorb the 266 MW latent heat of vaporisation would then be around 4140 kg/sec. Although passing through the transonic region creates complications, supersonic Venturi flows are achievable.

Velocities of around Mach 2 will reduce absolute temperature to around 40% of the original temperature, or −151 degrees Centigrade. The air mass flow required in such an embodiment would be around 1445 kg/sec. For larger overall depressurisations, it may be preferable to depressurise in several stages and also recover energy during the intermediate stages to avoid structural problems and ice formation, and for larger scale configurations involving a substantial air mass flow, parallel Venturi effect flows are likely to be preferred to maximise surface area, reduce wall thicknesses, and optimise flow.

Bernoulli's principle concerns the equivalence of static and dynamic pressure in fluid flow. As a pressurised fluid is released and gains velocity, some of the static pressure or potential energy of that fluid is converted into dynamic pressure or kinetic energy. The total pressure, which is the sum of the static and dynamic pressures, remains constant in absence of any external factors. However, in the present system, thermal energy in the Venturi condenser is an external factor which causes the air volume to expand. In the downstream direction towards the air motor or turbine, this expansion causes an increase in dynamic and therefore total pressure, which allows a more energetic expansion. In the upstream direction towards the storage unit, this thermal expansion is against the direction of flow, therefore this backpressure converts both itself and also some of the velocity of the air into static pressure. As before, the upstream gas also has an increased total pressure, although unlike the downstream flow, the velocity would reduce rather than increase. This effect continues into the hydrostatic storage unit to where the velocity is zero. Since there is no dynamic pressure at that point, the static pressure of the air momentarily increases above the hydrostatic pressure level. This additional pressurisation energy combined with the hydrostatic pressurisation is instantly available to drive the gas through the riser pipe-work and Venturi.

The electrical efficiency level of the electrolysis and hydrogen oxygen combusting turbine described above will be around 60 percent in isolation without recovering the heat of vaporisation, and similar efficiency levels can be expected of the compressed air subsystem. By combining the two systems, the combustion turbine no longer needs to pump significant quantities of water through that condenser to remove the heat since the Venturi condenser now performs that function. In addition, around 90 percent of the latent heat of vaporisation energy from the turbine is now recoverable in the Venturi condenser. The combined efficiency levels of the systems operating together are likely to be in the region of 80 percent or more.

In terms of energy density, at normal atmospheric pressure, hydrogen has a volume energy density of 3 kWh/cubic meter, and the amount of hydrogen produced from water electrolysis would be around twice the volume of oxygen. At 500 meters, the volume of both gasses reduce to less than 2 percent of the surface volume, giving volume energy densities of the hydrogen and oxygen gasses of 246 kWh per cubic meter. Such depths are commonplace within existing deep coalmines, many of which are now disused. The amount of air required to absorb the vaporisation energy as a ratio of the hydrogen and oxygen volumes is estimated at up to 100 times the volume for the subsonic case, and up to 10 times in the Mach 2 supersonic case. Even higher velocities might be practicable, which would potentially further reduce air volumes and condenser sizes, and further increase efficiency levels. These volumes compare favourably with hydroelectric pumped storage, where each cubic meter of water stores around 1-1.5 kWh of energy, and even more favourably to compressed air storage. Due to the very different energy densities involved, a system which displaces the equivalent water volumes of a hydroelectric pump storage plant with 6 hours generation duration might now be capable of powering the grid continuously for 4 consecutive days or more with a comparable instantaneous power output. The marginal costs of increasing the power capacity, say by adding an additional 1 GWh of storage, would be a small fraction of the pumped storage or compressed air energy storage equivalent.

BRIEF DESCRIPTION

Figure 5A:
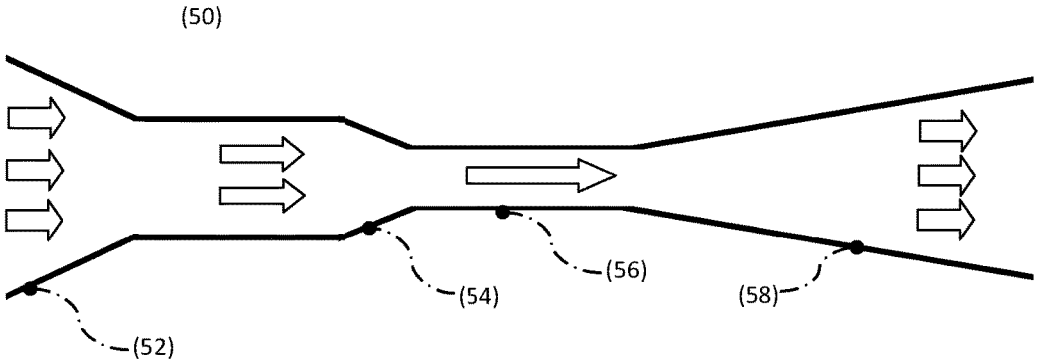
Figure 5B:
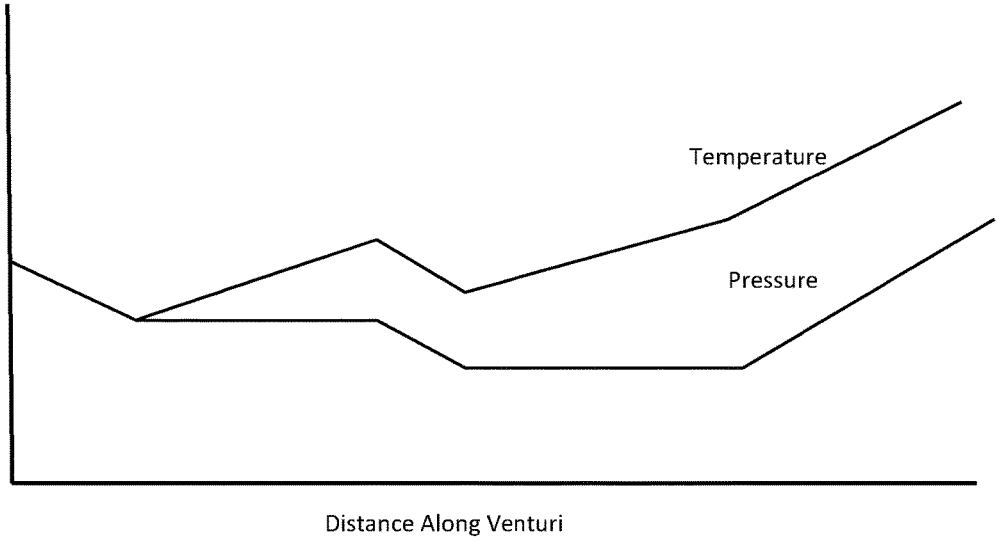

FIG. 5*a* shows an example of a multiple stage decompression in which the working fluid flows through two sections of a Venturi tube which each enable partial decompression. FIG. 5*b* shows a diagram of the variation of temperature and pressure along the Venturi tube.

DETAILED DESCRIPTION

The following embodiments are shown by way of example only. More complex arrangements may be preferred which will be further embodiments of this invention. By way of example such embodiments may include any turbine generating arrangement which includes the condensing mechanism as shown, a plurality or combined use of any of the components shown, or additional components which supplement the components and methodology shown. Examples of additional components are parallel gas flows and fins on the tubular sections within the Venturi condenser, electrical control and ancillary equipment, and various valves and nozzles to control, adjust, or maintain the gas flow. The working fluid to be condensed is typically steam, and the gas used to condense that working fluid is typically air, or parallel flows of air and pure oxygen, although other working fluids and or gasses might be used where appropriate.

Figure 1:
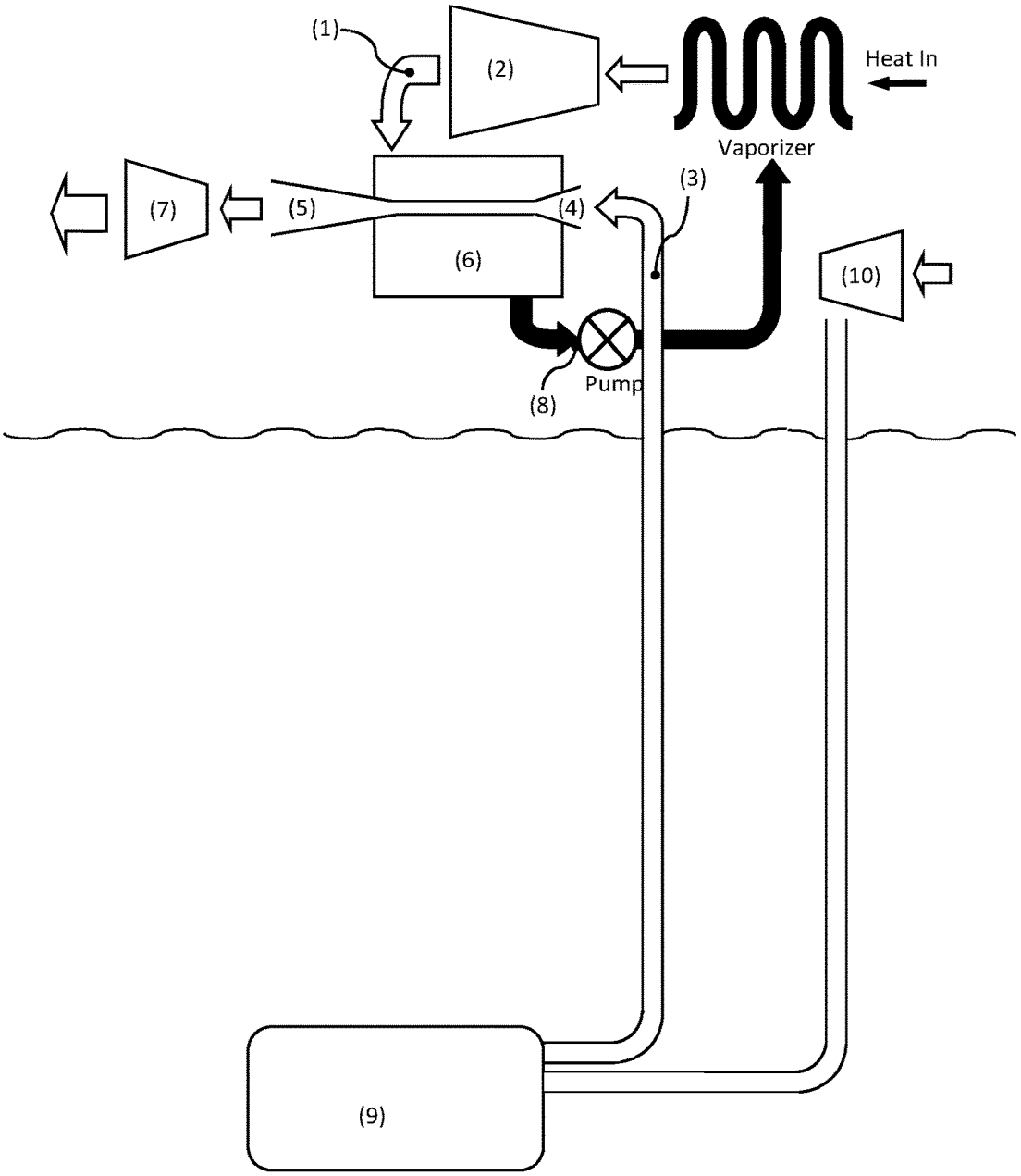
FIG. 1 shows a schematic representation of a Venturi condenser within a thermal power plant with a hydrostatically pressurised stored gas flow.

Referring to FIG. 1, there is shown a schematic diagram of a system in which a hydrostatically powered condenser using the Venturi effect extracts energy from a thermal power plant turbine. During energy extraction, the exhausted steam or other first working fluid (1) enters a condenser (6) in a slightly superheated or saturated state, as much of the useful energy has already been extracted during expansion through a first turbine (2). A significant proportion of energy remains in the first working fluid (1) at this stage due to its latent heat of vaporisation which cannot be recovered in the turbine. Some or all of this energy is extracted by a second working fluid in gaseous form (3) which is forced under hydrostatic pressure through the condenser via at least one ducted pipe arrangement in the form of a Venturi tube. This second working fluid gas passes through a restricted section of the Venturi tube at or within the condenser. The Venturi tube comprises, in known manner, at least one converging (4) and diverging (5) sub-sections and one narrowed straight section between each converging and or diverging sections. As the second working fluid gas passes through (4), its pressure drops and is converted into velocity, which effect reduces its temperature allowing significant heat absorption from the first working fluid. As the second working fluid extracts thermal energy from the first working fluid which is exhausted from the first turbine (2), this causes a phase change from gas to liquid and consequently a volume reduction in that fluid, creating a lower pressure within the condenser (6) and consequently encouraging and enhancing flow through the turbine (2). When the second working fluid is re-pressurised within diverging section (5) the pressure increase raises its temperature to an elevated level which is higher than the temperature in the condenser. Advantageously this section is thermally isolated from the condenser to prevent any transmission of heat during this stage to the first working fluid. The ducted gas can then be expanded within a second turbine (7), or other suitable means of energy extraction. The condensed first working fluid exiting the condenser at (8) is now re-circulated in liquid form to a pump where it is re-pressurised, then passes to a heat source where it is vaporised, and then used to drive the first turbine (2) to generate electricity.

When operating in energy storage mode, a gas is compressed by compressor (10) and transmitted into a hydrostatically pressurised unit or container (9), typically using off-peak or low demand electricity in compressor (10). In some embodiments compressor (10) could be the same, or part of the same component, as second turbine (7). It would also be possible to recover the thermal energy due to the heat of compression at this stage, possibly using that heat as an energy source to assist the compressor in order to increase overall efficiency levels. The hydrostatic pressure maintains the gas at a constant pressure throughout discharge allowing the condensing energy to be stored for later use within the Venturi condenser, avoiding an energy drain during generation to increase the maximum available output.

In another alternative embodiment, the Venturi condenser may advantageously be provided with a plurality of Venturi tubes arranged to operate in parallel. The input to the tubes can be arranged to receive the second working fluid from the hydrostatic storage unit (9). An advantage of the plurality of Venturi tubes is that the heat exchanger means can be arranged to transfer heat more efficiently between first and second working fluids because of the closer proximity of the working fluids. Additionally, the gas flow in the Venturi tube can be maintained at or closer to the ideal linear flow, so maintaining the effectiveness and efficiency of the system.

In another alternative embodiment, the Venturi condenser may comprise one or a plurality of Venturi tubes where at least one of these Venturi tubes include more than one converging and straight sections arranged in series to allow depressurisation to occur in stages, and where thermal energy is absorbed by the second working fluid in the intermediate stage or stages when the second working fluid is partially depressurised as well as when that fluid is fully depressurised in the final stage of depressurisation. An advantage of staged decompression over an equivalent single stage decompression is that the low temperature extremes which the first working fluid would be exposed to are reduced, which temperature extremes may have caused structural complications and ice formation.

Figure 2:
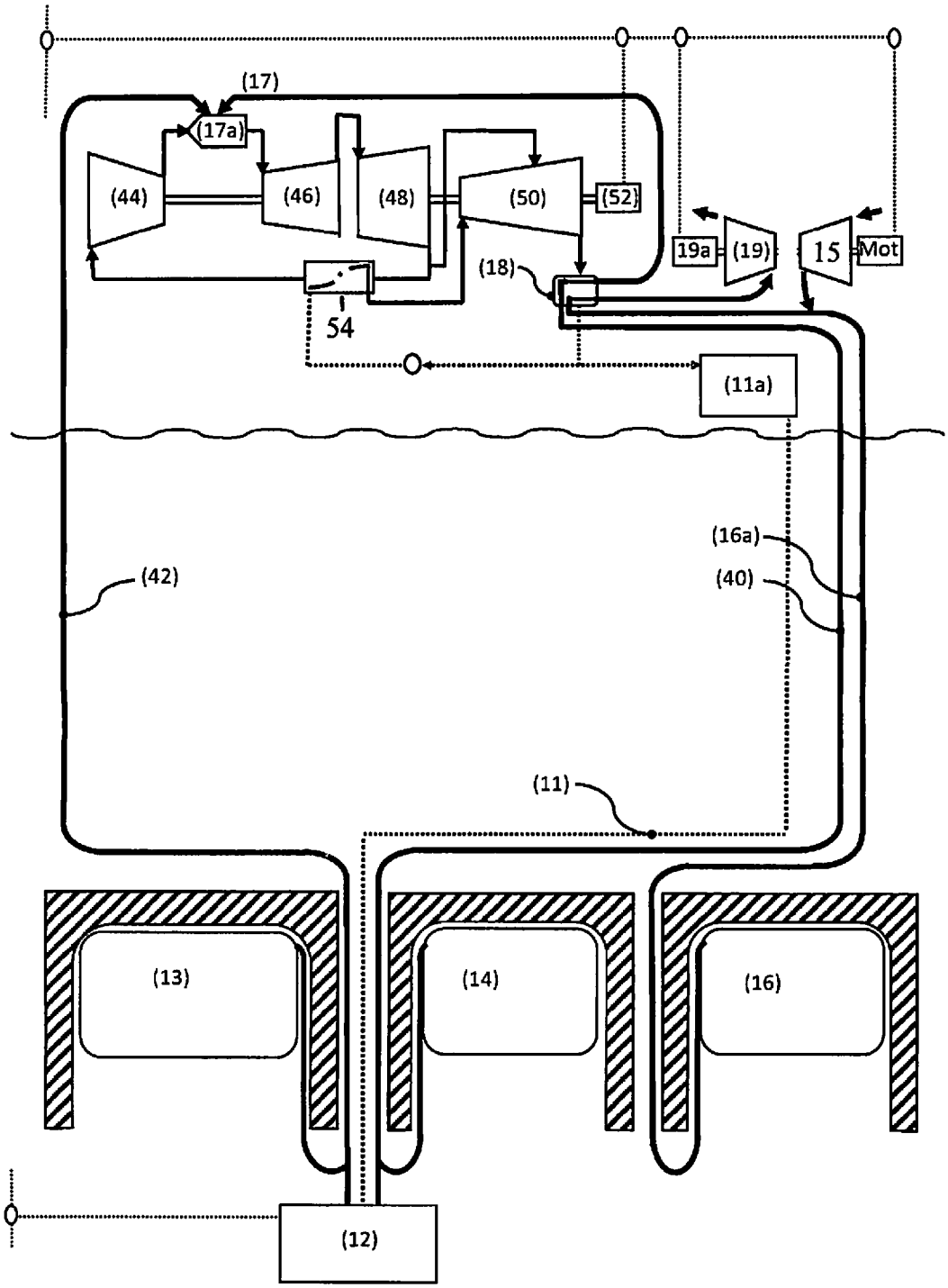
FIG. 2 shows a schematic diagram of a hydrogen oxygen electrolysis and gas turbine generation system with hydrostatically pressurised fuel, oxygen, and air storage.

Referring to FIG. 2, there is shown a schematic diagram of a system in which a Venturi condenser powered by a hydrostatically pressurised gas which is used to extract energy from a hydrogen oxygen turbine generation and water electrolysis system. A water reservoir (11*a*) feeds a water feed (11) used by an electrolysis system (12) to produce hydrogen and oxygen gas which is gas stored under pressure in underwater storage means (13) and (14) and which water feed is supplied under hydrostatic pressure. The water feed shown is taken from exhaust steam from the turbine generator assembly (17) although it could also be externally sourced, possibly from surrounding water. The water reservoir (11*a*) is provided to accommodate the different fluid volumes of the electrolyser water feed. The electrolysis system (12) is supplied with an external source of electricity, typically off peak or low demand electricity, and used to produce hydrogen and oxygen gasses which are allowed to rise through pipe-work into storage units (13), and (14). Air is also compressed during a storage phase by a compressor (15) and transmitted through separate pipe-work into air storage unit (16). Each storage unit subjects its gas to a relatively constant hydrostatic pressure. A possible method of recovering the heat of compression and reusing that energy to increase efficiency is also shown. The method shown comprises a Rankine heat extraction cycle, which Rankine cycle vaporises the water supply using the available heat of compression and then transfers the steam to part of the expansion turbine (17) to generate electricity, which electricity is supplied to the electric motor to assist with driving the compressor. The steam is then condensed back to water and pumped back to the vaporiser. The storage units shown here in this example are flexible membranes contained within rigid ballasting outer structures. On demand, the hydrogen and oxygen gasses are released from storage means 13 and 14 under hydrostatic pressure and transmitted to the hydrogen oxygen turbine generator (17) where they are combusted in a combustion chamber (17*a*) in order to generate electricity. The air, from storage unit (16) is transmitted through at least one separate duct (16*a*) to a condenser (18). The condenser (18) provides condensing and heat recovery through the Venturi effect before being expanded through air motor or turbine (19). The air motor or turbine received output from the one or more Venturi tubes, the output from the Venturi tubes having sufficient energy to drive an air motor or turbine (19) which is coupled to a second generator (19*a*). Second generator (19*a*) provides an output to an external power supply. Alternatively, any power produced can be used to provide energy to operate the system.

The oxygen gas in this embodiment is also transmitted through condenser (18). The oxygen is fed into the inlet portion of one or more Venturi tubes and as it passes through the Venturi tube it cools, expands and is re-pressurised on exit from the Venturi tube part of the condenser (18). Upon exiting the condenser the oxygen is fed to the combustion chamber (17*a*). An advantage of supplying oxygen gas at elevated temperature is that it raises the heat of combustion and increases the power output of the hydrogen oxygen gas turbine.

The turbine generator set (17) includes a combustion chamber (17*a*) which receives oxygen from the Venturi condenser (18). Separate lines feed oxygen from an oxygen riser (40) to condenser (18) and then to combustion chamber (17*a*). A hydrogen riser (42) separately supplies hydrogen gas to the combustion chamber. A compressor unit (44) compresses steam, a portion of which has been recirculated following its expansion in turbines (46, 48), which recirculated steam is supplied to the combustion chamber.

Output from the combustion chamber is used to drive one or more turbine sets (46, 48) to extract energy and generate electricity in generator (52). A low pressure turbine (50)

receives some output from the turbine (46, 48) which is in gaseous form The remainder of the output not supplied to low pressure turbine (50) is recirculated, where it is passed through a heat exchanger means (54) in which the heat is extracted, and then compressed (44) and supplied to the combustion chamber. The extracted heat is transferred to the flow used to drive low pressure turbine (50). Output from the low pressure turbine (50) is passed to the Venturi condenser (18) which operates in a similar manner to that described above.

This particular arrangement can be described as a form of combined cycle, where the combustion, expansion, and recirculation, and compression of a portion of steam form part of a closed Brayton cycle, and the extraction of heat from the Brayton cycle exhaust in a second portion of steam, the expansion of that second portion of steam in a turbine, and the condensing, pumping to pressure, and recirculation of that second portion of steam condensate form part of a bottoming Rankine cycle.

Figure 3:
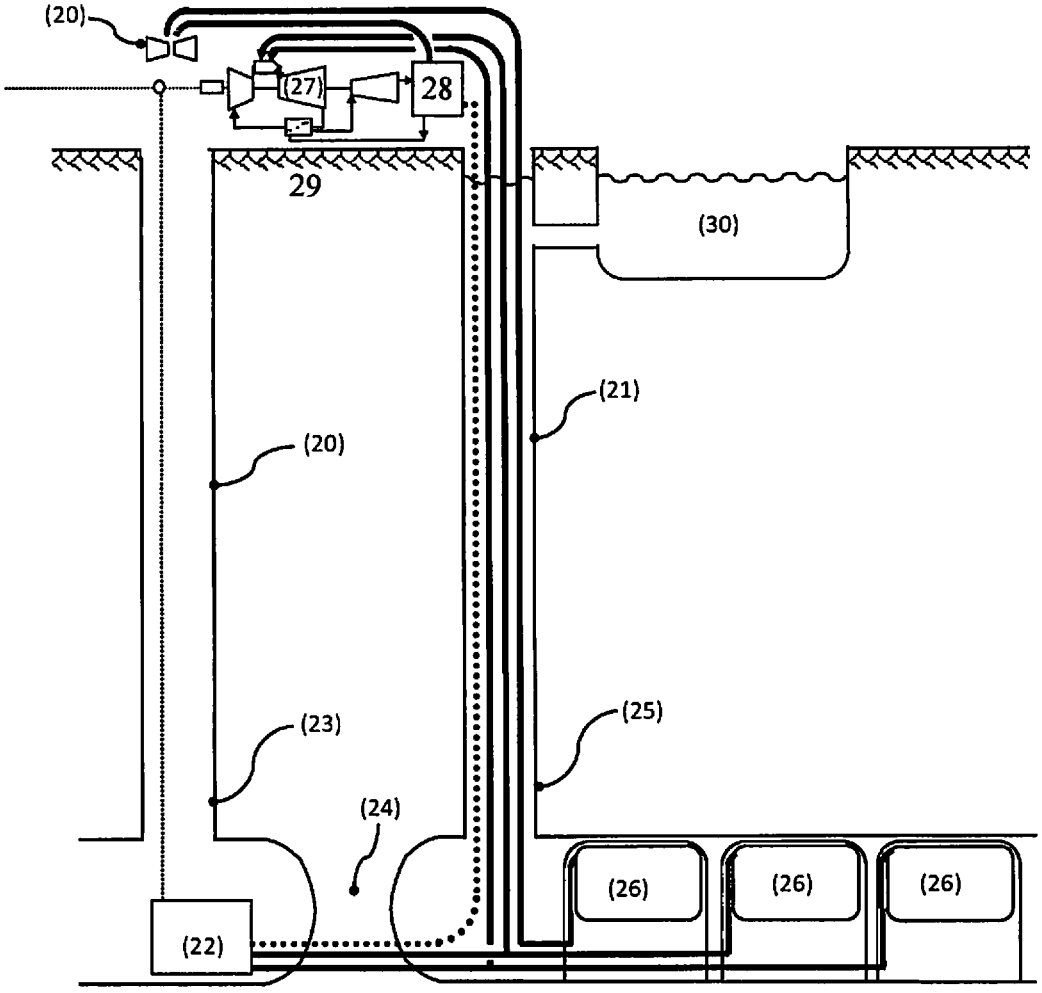
FIG. 3 shows an example configuration of a hydrogen oxygen electrolysis and compressed air system within a former coal mine.

Referring to FIG. 3, there is shown a system located within an adapted deep coal mine. Two vertical shafts have been converted. Shaft (20) contains a means of access to the electrolysis system (22) located at the bottom of the shaft below and also the power supply. Shaft (21) is flooded to provide hydrostatic pressurisation of the storage units, and contains pipe-work for the gasses and a separate column of water feed for the electrolysis system. This arrangement is by way of example only.

Although the electrolyser shown is not submerged, its water feed is hydrostatically pressurised, which pressurisation can then directly be transferred to the gasses produced through electrolysis. The electrolysis system (22) may be housed within a part of a mine gallery (23) which is not flooded and is accessible through Shaft (20). Separator Section (24) separates the flooded section from the non-flooded section and contains the pipe-work for transmitting hydrogen and oxygen gasses and water supply. Section (25) is a flooded section subjected to hydrostatic pressure by the water column in (21), and contains the storage units which are shown as flexible membranes (26) containing gaseous hydrogen, oxygen, and air within different rooms in the mine. Any number of discrete units might be used for each of the gasses although only three are shown here. The gasses are variously supplied to a hydrogen and oxygen combusting gas turbine arrangement (27) operating in conjunction with a power generating system of the type shown in FIG. 1 and described above, a compressed air system (28), and a Venturi condenser (29). Variations in water level of the hydrostatic pressurisation fluid which may result from differing levels of gas storage can be accommodated by reservoir (30) which maintains the hydrostatic pressure at a relatively constant level.

As described above, hydrogen and oxygen lines rise separately from the respective hydrostatically pressurised storage units (26). Operation of the system is similar to that described for FIG. 2 above.

Figure 4:
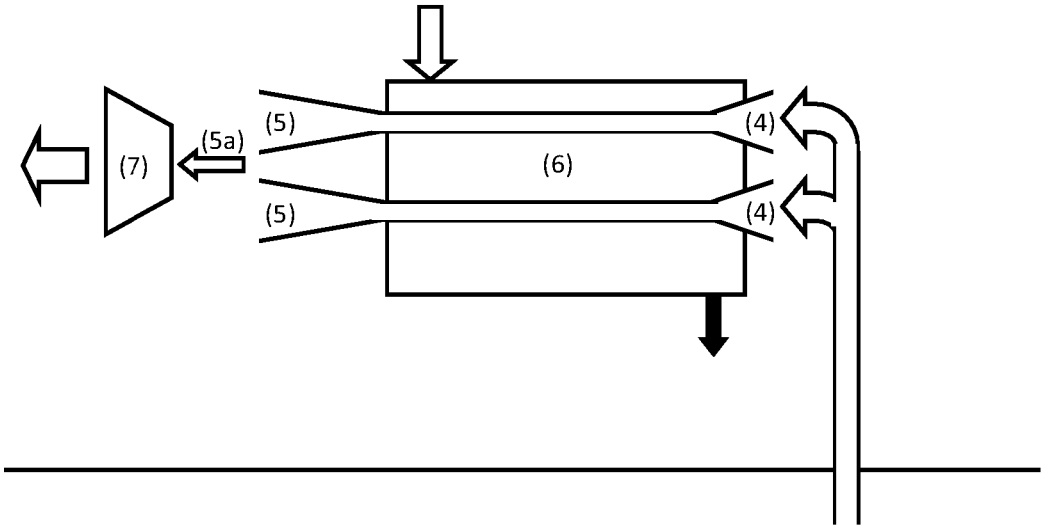
FIG. 4 shows an example of a configuration in which the Venturi Condenser has two Venturi tubes operating in a parallel mode.

FIG. 4 shows an example of a parallel arrangement of Venturi tubes in a Venturi condenser. In this example there are only two tubes shown for simplicity and clarity but any suitable number could be deployed. Factors affecting the number of tubes include volume of fluid to pass through the tubes, the temperature difference between the fluid at the input region (4) and diverging output region (5). A further factor to be considered refers to the efficiency of the heat exchangers (not shown) surrounding the diverging portion of the Venturi tube.

The inlet for the tubes is connected to a common conduit (4*a*) feeding working fluid to all the tubes. Each tube is provided with its own converging portion (4) diverging portion (5) and a central portion.

Output from the tubes converges at (5*a*). The output from the Venturi condenser exits through a common output conduit to enter a secondary power turbine (7).

FIG. 5*a* shows a different method of operation in which there is a multiple stage pressure reduction in pressure, which is referred to as a series type arrangement. An inlet portion (50) shows the inlet region in general. A first inlet portion (52) provides a first stage of pressure reduction. The incoming fluid will decrease in pressure and accelerate as it passes along the tube to a second converging region (54). In this region the pressure of the fluid is further reduced and accelerated before passing through a central region (56) in which it reaches its maximum velocity. The fluid then enters the diverging zone (58) where the velocity slows and pressure rises. Heat exchanger means (not shown) surround the diverging portion (58) and heat is transferred from a first working fluid to the second working fluid passing through the Venturi tube.

FIG. 5*b* shows a graph of temperature and pressure variations along the tube.

In the series arrangement, the intermediate stage could advantageously comprise multiple parallel tubes for the straight section to maintain laminar flow characteristics of the working fluid. An additional advantage is that it could enable a reduced wall thickness (and therefore facilitate heat transfer), and also increase contact area between the first and second fluids (again to facilitate heat transfer). In another embodiment, in order to preserve a symmetric shape, 2 flows could be used each flowing in opposite directions.

It can be envisaged that in certain circumstances it would be advantageous to have both aspects of multiple stage and a parallel arrangement to Venturi tubes in a Venturi condenser.

The invention claimed is:

1. A method of energy recovery for a thermal power plant, said method comprising the following steps:

(a) a first working fluid delivering energy to a main power generating turbine then passes through a heat exchanger means in a Venturi condenser whereupon at least some of the energy remaining is extracted, and at least some of the first working fluid condenses to a liquid state;

(b) a second working fluid enters one or more Venturi tubes in the Venturi condenser at elevated pressure, the second working fluid cooling and decreasing in pressure as it passes through the one or more Venturi tubes the second working fluid absorbing thermal energy from the first working fluid in the heat exchanger means in the Venturi condenser;

(c) a reduced volume of the first working fluid causing a decreased pressure downstream of the main power generating turbine which increases flow of the first working fluid through the main power generating turbine;

(d) the second working fluid after absorbing thermal energy in the heat exchanger means passing through a second power generating turbine where energy is extracted.

2. The method of energy recovery according to claim 1 wherein the second working fluid, ducted through the Venturi condenser during periods of higher electricity demand to provide condensing and energy recovery, is compressed using off peak or lower demand energy it for storage under hydrostatic pressure for release on demand.

3. The method of energy recovery according to claim 1 in which hydrogen and oxygen gasses are produced by a method of water electrolysis, the gasses are stored under hydrostatic pressure, are introduced into and combusted in a gas turbine, the combustion producing the first working fluid which is condensed using the Venturi condenser.

4. The method of energy recovery according to claim 2 wherein storage units are located within an adapted deep mine or part of an adapted deep mine and the hydrostatic pressure is derived from a mineshaft.

5. The method of energy recovery according to claim 3 wherein storage units are located within an adapted deep mine or part of an adapted deep mine and the hydrostatic pressure is derived from a mineshaft.

6. A power generating system comprising a thermal power plant including:

(a) a vaporiser means for vaporising a first working fluid, a conduit means for conducting said (vaporised) first working fluid to a main power generating turbine for extracting energy from the first working fluid;

(b) conduit means for taking the first working fluid exiting the main power turbine to a Venturi condenser, the first working fluid passing through heat exchanger means in the Venturi condenser to transfer heat to a second working fluid;

(c) the Venturi condenser, provided with an inlet for receiving the second working fluid at elevated pressure, an inlet leading to one or more Venturi tubes, the one or more Venturi tubes having a converging inlet portion, a straight constricted portion and a diverging outlet portion, a further heat exchanger means surrounding the diverging outlet portion;

(d) a second power turbine for extracting energy from the second working fluid exiting the one or more Venturi tubes;

(e) conduit means for returning said first working fluid to the vaporising means;

(f) pumping means for pressurising and returning said first working fluid to the vaporising means;

(g) pump means for optionally pumping the second working fluid to a hydrostatically pressurised storage unit;

(h) storage means for storing said second working fluid in gaseous state under hydrostatic pressure; and (i) conduit means for conducting the second working fluid from said storage means to the inlet of the Venturi condenser.

7. The power generating system according to claim 6 further including an electrolysis system for electrolysing water to produce hydrogen and oxygen gasses.

8. The power generating system according to claim 7 in which said second working fluid includes oxygen produced by the electrolysis system and released from the storage means for storing said oxygen gas under pressure.

9. The power generating system according to claim 6 in which the Venturi condenser has a plurality of Venturi tubes arranged to operate in parallel.

10. The power generating system according to claim 6 in which the Venturi condenser has a plurality of Venturi tubes arranged to operate in series.

11. The power generating system according to claim 9 in which the Venturi condenser includes the heat exchanger and/or the further heat exchanger means arranged to interact with the plurality of Venturi tubes to transfer heat from the first working fluid to the second working fluid.

* * * * *